United States Patent [19]

Bowers

[11] 4,241,387

[45] Dec. 23, 1980

[54] LAMP LEAD TO WIRE ATTACHMENT FOR INTEGRAL STRING SETS

[75] Inventor: Harry J. Bowers, Mayfield Heights, Ohio

[73] Assignee: General Electric Company, Schenectady, N.Y.

[21] Appl. No.: 859,055

[22] Filed: Dec. 9, 1977

[51] Int. Cl.[3] ..... F21P 1/00

[52] U.S. Cl. ..... 362/252; 362/806

[58] Field of Search ..... 362/252, 251, 253, 363, 362/397, 396, 806, 810, 436, 267; 313/315; 315/64, 66, 69

[56] References Cited

U.S. PATENT DOCUMENTS

| | | | |
|---|---|---|---|
| 2,071,948 | 2/1937 | Peters | 76/16 |
| 3,300,851 | 1/1967 | Lodder | 29/470.1 |
| 3,404,453 | 10/1968 | Moranduzzo | 29/628 |
| 3,727,042 | 4/1973 | Evans et al. | 362/252 |
| 4,028,798 | 6/1977 | Bechard et al. | 29/628 |

*Primary Examiner*—Benjamin R. Padgett
*Assistant Examiner*—J. L. Barr
*Attorney, Agent, or Firm*—Lawrence R. Kempton

[57] ABSTRACT

A string set construction is disclosed in which the leads from a wire lamp are mechanically joined to wire in the power cord by a plastic sandwich including the insulation on the power cord.

19 Claims, 4 Drawing Figures

LAMP LEAD TO WIRE ATTACHMENT FOR INTEGRAL STRING SETS

This invention relates to the connection between an electrical device and an insulated cable or cord or, more particularly, to lamp and cord construction in integral string sets.

In the past, a variety of constructions have been used to electrically connect an electrical device, eg. a lamp or socket, to a cable or power cord. Considering prior art decorative string sets as one, but not the only, example, the lamp is connected to the cord by way of a socket. The socket generally comprises conductive tabs which are crimped, twisted, soldered, or welded to the stripped ends of the wires in the cord. The stripping, crimping, etc. all involve complex assembly procedures which add to the cost of the string set. Further, however reliably the socket is connected, a lamp must be inserted and make good contact with the socket, a condition not necessarily obtained in the hands of the consumer. Also, the string set must be mechanically strong at the connections to withstand handling, particularly the stress due to pulling in the direction of the wire.

If the string set is intended for outdoor use, the connections must be further protected from the environment to avoid deterioration of the connections or possible short circuits due to moisture. In the prior art, string sets designated as suitable for outdoor use are noticably heavier in construction and generally costlier to make. Further, whatever the recommendations of the manufacturer, there is a problem in that some consumers will use an indoor set outdoors, despite the attendant risks.

In view of the foregoing, it is therefore an object of the present invention to provide an improved connection between an electrical device and insulated wire.

Another object of the present invention is to provide a superior integral string set.

A further object of the present invention is to provide a string set suitable for use either indoors or outdoors.

Another object of the present invention is to provide a mechanically strong string set.

A further object of the present invention is to simplify the construction of integral string sets.

The foregoing objects are achieved in the present invention wherein the lead wires from each lamp are mechanically clamped to the wires in a power cord by a plastic sandwich which is thermally or ultrasonically softened temporarily. In one embodiment of the present invention, the insulation is not removed from the free ends of the power cord to which the lamp is joined. In another embodiment, the insulation is removed.

A more complete understanding of the present invention can be obtained by considering the following detailed description in conjunction with the accompanying drawings, in which.

Figure 1:
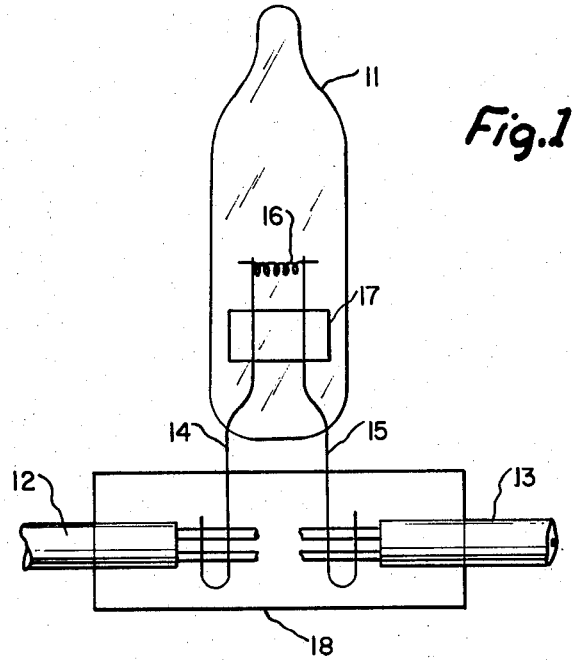
FIG. 1 illustrates a partially assembled lamp and wire sandwich.

FIG. 1 illustrates a side view of a preferred embodiment of the present invention as used in fastening wire lamps to the wire of a string set. Specifically, a series connected string set as used for decorative lighting during holidays may be considered as a plurality of lamps interconnected by a plurality of wire segments, the lamps and segments together combining to form the series circuit which is connected to a plug. In FIG. 1, wire lamp 11, that is, a lamp having lead wires extending from the sealed end thereof but lacking any base or base structure, is connected to insulated wire segments 12 and 13 by way of lead wires 14 and 15. In a preferred embodiment of the present invention lead wires 14 and 15 are doubled back on themselves to increase the number of contacts with segments 12 and 13. It is also preferred, although not necessary for the present invention, that segments 12 and 13 comprise what is known as stranded wire, ie. a plurality of strands of wire twisted together as opposed to a single solid conductor. Wire segments 12 and 13 are interconnected by lead wires 14 and 15 and filament 16. Also illustrated in the embodiment of FIG. 1 is a shunt 17 such as disclosed in application Ser. No. 859,056 filed concurrently herewith and assigned to the assignee of the present invention. Shunt 17 provides the dual functions of supporting and positioning lead wires 14 and 15 within lamp 11 as well as continuing the circuit in the event filament 16 opens.

Located from behind segments 12 and 13 is a plastic sheet 18 which encloses the contact area between segments 12 and 13 and lead wires 14 and 15 respectively. The function of plastic sheet 18 can be better understood by considering FIGS. 2 and 3 which comprise end views of a preferred embodiment of the present invention, before and after sealing respectively.

Figure 2:
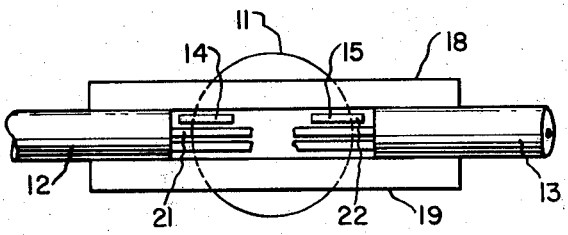
FIG. 2 illustrates a bottom view of the assembled sandwich prior to softening the plastic.

As illustrated in FIG. 2, overlying the other side of a contact area is a second plastic sheet 19 of the same general proportions as sheet 18 and approximately parallel thereto. Lead wires 14 and 15 respectively touch conductors 21 and 22 from segments 12 and 13. The lead wires are not soldered, welded, or otherwise electrically bonded to conductors 21 and 22. In assembling a string set in accordance with the present invention, plastic sheets 18 and 19 are deformed, eg. by thermal or ultrasonic means, to bond to each other and the insulation on segments 12 and 13, thereby sealing the region of contact between lead wires 14 and 15 and wires 21 and 22 respectively.

Unlike prior art contacts formed in deformed plastic, it has been found that one conductor, eg. wire 14, need not rest on an anvil for the other conductor, eg. lead wire 12, to make reliable contact therewith. During the bonding or deformation, the conductors are surrounded by plastic in a liquid state and, upon cooling, are brought into electrical contact. As should be apparent, this simplifies manufacture since an exposed conductor does not have to be covered in subsequent operations: a totally enclosed, mechanically and electrically secure connection is made in a single operation.

While illustrated for the sake of clarity in FIGS. 1 and 2 as having the ends thereof stripped, wire segments 12 and 13 preferably comprise a core conductor surrounded over its entire length by an insulating jacket. It has been found that during the deformation this insulation does not interfere with the contact between lead wires 14 and 15 and conductors 21 and 22. It appears that the lead wires simply penetrate through the plastic in the fluid state and make mechanical contact with the conductors. In this manner, the construction of string sets in accordance with the present invention is even more simplified, requiring only the severance of the insulated wire into segments.

Figure 3:
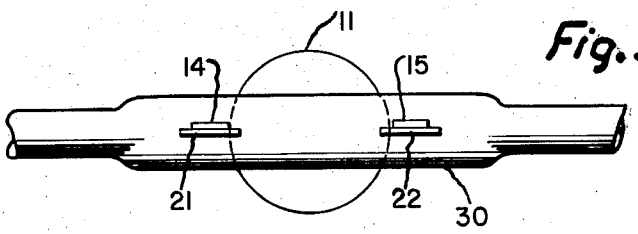
FIG. 3 illustrates the sandwich after softening.

As illustrated in FIG. 3, the deformation of sheets 18 and 19 causes the plastic, which may comprise any suitable thermoplastic such as polyvinylchloride (PVC), to flow into the region and force lead wires 14 and 15 into mechanical contact with wires 21 and 22 respectively. It is a characteristic of most thermoplastics that upon going from the liquid state to the solid state, some shrinkage occurs. This shrinkage causes a continuous pressure to be applied to the contact thereby assuring a reliable electrical connection despite the absence of solder or welds. Further, since the plastic sheets are bonded to each other as well as to the plastic insulation around segments 12 and 13, the entire contact area is sealed against hostile environments as well as being mechanically strong, as strong as wire segments 12 and 13 themselves.

Figure 4:
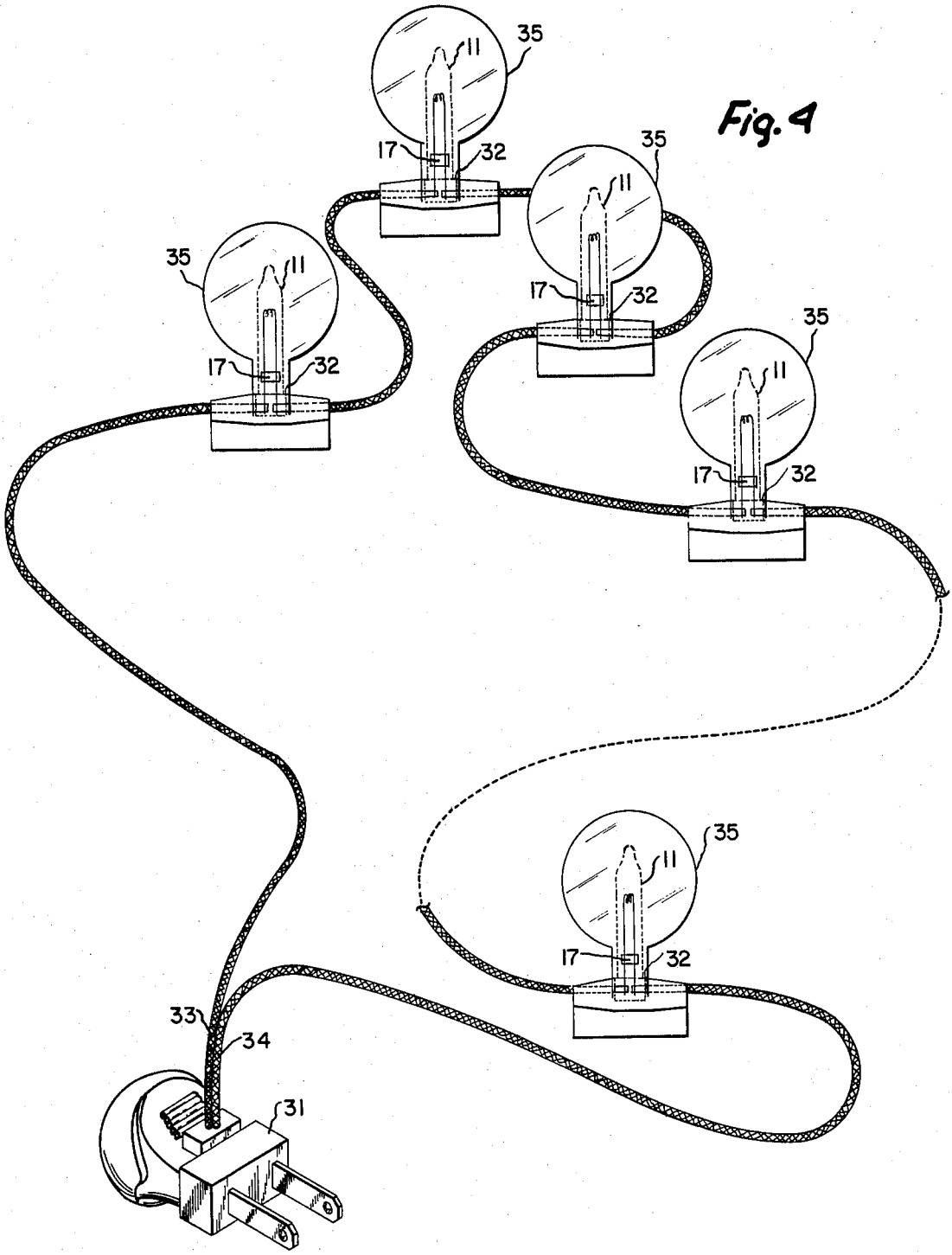
FIG. 4 illustrates an integral string set in accordance with the present invention.

FIG. 4 illustrates a string set in accordance with the present invention wherein a plug 31 has connected thereto a plurality of wire segments, such as segments 33 and 34 which in turn are interconnected by a plurality of lamps 11. Surrounding lamps 11 are ornamental structures such as disclosed in application Ser. No. 859,057 filed concurrently herewith and assigned to the assignee of the present invention. As described in that application, ornamental structures 35 preferably comprise a unitary plastic part having tabs on the lower portion thereof which fit around the contact area of the lamp as well as a portion of the wire segment connected thereto. In accordance with the present invention, these tabs may be substituted for plastic sheets 18 and 19 or may be provided in addition to plastic sheets 18 and 19 and further sealed to each other and to the insulation of the wire segments. In the latter form, the connections between the wire segments and lamps 11 are thus doubly sealed against the environment, thereby providing a light-weight, easily constructed string set which may be used either indoors or outdoors.

Having thus described the invention it will be apparent to those of ordinary skill in the art that various modifications can be made within the spirit and scope of the present invention. For example, the choice of a particular thermoplastic depends on considerations external to the present invention, eg. cost and government regulations. Further, while illustrated as connected to segmented wire, wire lamps may also be connected across continuous, parallel conductors in accordance with the present invention. For this connection, the thermal or ultrasonic source is suitably shaped to contact the sheets at the appropriate locations. The resultant string set then comprises parallel connections of the lamps.

I claim:

1. In a decorative string set having incandescent lamps permanently connected to segments of insulated wire to form a series circuit, the improvement comprising:

each lamp having lead wires in contact with and transverse to the ends of respective segments of said insulated wire;

thermoplastic sheets disposed in an approximately parallel relationship, one on each side of said lead wires and said ends;

and wherein said sheets are thermoplastically bonded to each other and to the insulation on said ends of said insulated wire, said lead wires and segments of said insulated wires are embedded between, partially enclosed and held in electrical contact by said bonded sheets, and said bonded sheets maintain said lead wires and said segments in said electrical contact with a continuous pressure.

2. The decorative string set as set forth in claim 1 wherein each of said segments has a plastic insulator over the entire length thereof and wherein some of said insulator plastic is included in the bond of said lead wire to said segment end.

3. The string set as set forth in claim 1 wherein said lead wires of each lamp are doubled back on themselves for multiple contact with the ends of said respective segments.

4. The string set as set forth in claim 3 and further comprising a plurality of translucent ornaments, each at least partially enclosing a lamp and overlying said plastic sheets.

5. The string set as set forth in claim 3 wherein and further comprising a plurality of translucent ornaments, each having tabs on one end thereof and at least partially enclosing a lamp, wherein said tabs comprise said plastic sheets.

6. The string set as set forth in claim 5 wherein said plastic comprises polyvinylchloride.

7. The string set as set forth in claim 2 wherein said lead wires of each lamp are doubled back on themselves for multiple contact with the ends of said respective segments.

8. The string set as set forth in claim 7 and further comprising a plurality of translucent ornaments, each at least partially enclosing a lamp and overlying said plastic sheets.

9. The string set as set forth in claim 7 further comprising a plurality of translucent ornaments, each having tabs on one end thereof and at least partially enclosing a lamp and, wherein said tabs comprise said plastic sheets.

10. In an incandescent lamp string set, a sealed lamp lead wire to string wire electrical connection comprising:

a lamp lead wire;

a string wire comprising an insulated conductor;

said lamp lead wire being in approximately orthogonal contact with said string wire;

thermoplastic sheets disposed in an approximately parallel relationship on opposite sides of said lead wire and said string wire;

and wherein said sheets are thermoplastically bonded to each other and to the insulation on said string wire; and said lead wires are embedded between, partially enclosed and held in electrical connection by, said bonded sheets, and said bonded sheets maintain said lead wire and the conductor in said string wire in electrical contact with a continuous pressure.

11. The electrical connection of claim 10, wherein said lamp lead wire is insulated.

12. The electrical connection of claim 10, wherein said lamp string wire is fully insulated.

13. The electrical connection of claims 10, 11 or 12, wherein said lamp lead wire doubles back upon itself and makes a dual contact with said conductor in said string wire.

14. An electrical connection for a lamp comprising a thermoplastic sandwich having at least two thermoplastic sheets thermoplastically bonded to each other to partially surround and compressively hold a lamp lead wire in contiguous contact with a conductor for effecting a positive electrical connection therebetween.

15. The electrical connection of claim 14 wherein said thermoplastic sheets are thermoplastically bonded to a thermoplastic insulating cover on said conductor.

16. The electrical connection of claim 15 wherein said thermoplastic sandwich insulates and seals said mechanical and electrical connection.

17. An electric lamp and power supply thereof comprising:

(1) at least one electrical lead wire for the lamp, (2) at least one thermoplastic insulated electric power supply conductor, (3) a thermoplastic sandwich bonded to said lead wire and said power supply conductor for electrically attaching said lead wire to said power supply conductor and mechanically connecting said lamp to the insulated power supply conductor.

18. The electric lamp and power supply of claim 17 wherein said thermoplastic sandwich insulates and seals the electrically and mechanically attached lead wire and power conductor.

19. The electric lamp and power supply of claim 18 wherein said electrical lead is transverse to said power conductor.

* * * * *